US005755649A

United States Patent [19]

Bimby

[11] Patent Number: 5,755,649

[45] Date of Patent: May 26, 1998

[54] CHEST EXERCISING DEVICE

[76] Inventor: Michael Bimby, 144-26 Gravett Rd., Flushing, N.Y. 11367

[21] Appl. No.: 733,492

[22] Filed: Oct. 18, 1996

[51] Int. Cl.[6] ..... A63B 21/02

[52] U.S. Cl. ..... 482/126; 482/121

[58] Field of Search ..... 482/121, 62, 126, 482/51, 70

[56] References Cited

U.S. PATENT DOCUMENTS

| | | | |
|---|---|---|---|
| 610,716 | 9/1898 | Marshall | 482/121 |
| 3,475,221 | 10/1969 | Ruegsegger | 482/70 X |
| 4,625,963 | 12/1986 | Lancellotti | 482/62 |
| 4,743,015 | 5/1988 | Marshall | 482/70 |
| 5,123,886 | 6/1992 | Cook | 482/121 X |
| 5,299,996 | 4/1994 | Chi | 482/52 X |
| 5,458,555 | 10/1995 | Ko | 482/126 |

OTHER PUBLICATIONS

Vie Freestyle magazine cover page—pp. 36 thru 40—two pages (unnumbered) of advertisement, Dec. 1996.

*Primary Examiner*—Richard J. Apley
*Assistant Examiner*—William LaMarca
*Attorney, Agent, or Firm*—Gottlieb, Rackman & Reisman, P.C.

[57] ABSTRACT

The device comprises a free-standing, floor mounted base unit having extending therefrom a pair of pivoting sleeves. Inserted into the sleeves, in an easily removable manner, are a pair of levers. In use, the chest exercising device allows for a full range of adduction and abduction chest exercising arm movements, which movements are easily adjustable for resistance, and due to the pivoting movement of the sleeves, impingement at the shoulder joint is prevented.

12 Claims, 7 Drawing Sheets

CHEST EXERCISING DEVICE

BACKGROUND OF THE INVENTION

This invention relates to the field of exercise machines, and more particularly, to an exercise machine for developing an exerciser's chest muscles.

Exercising and going to gymnasiums has become common place in today's society. When at such gymnasiums, individuals do many different types of exercises, ranging from aerobic exercise to tone muscles and strengthen the cardiovascular system, to intense weight training for the purpose of selectively increasing muscle size and strength.

One of the main areas of concentration for exercisers is chest muscle development. There is one significant chest muscle called the pectoralis major. In adduction exercises (those where the shoulder joint is rotating inwardly), different parts of the pectoralis major are exercised; the upper, middle and lower muscle fibers, depending upon the angle of the adduction movement of the arms, as measured at the shoulder joint.

In weight training, to develop real-life muscle size and strength, as opposed to muscle size and strength developed from exercises performed while in a singular, fixed body position (as when the exerciser is lying or sitting on an exercise machine, for example, a bench press apparatus), it would be more advantageous to perform an exercise without external support being provided to the exerciser's body. The muscle size and strength gains on such singular fixed position exercise machines have far more limited "real-life application potential" in comparison to exercises performed where the body itself provides the support; as is required with real-life sport. For example, while a person may be able to bench press 300 lbs., that same person might only be able to press 75 lbs. without the external back support provided by the bench press device. So while muscle strength is usually defined by the amount of weight a lifter can lift in a single repetition of the exercise, this type of strength is meaningless in the real world, where one has to do real work.

Accordingly, while it is desirable to build one's muscle size and strength through use of machines which lend body support to the exerciser, it would be more realistic, and therefore more desirable, to build those same muscles easily and conveniently with a non-support device.

Examples of other weight lifting/resistance providing devices which achieve a non-support result, and that are either designed specifically for, or can be used for chest exercising, are as follows:

1. Free weights (barbells, dumb-bells, and related free weight designs, including, but not limited to, the E-Z curl bar, and tricep bar). With regard to free weights, the disadvantages are: the immense inconvenience of always having to change the weights, their awkwardness, lack of portability, large work-out space required, supportive apparatus required, relative high cost, not convenient to store, destructive to flooring, noisy, produce annoying vibrations when lowered to floor thus creating a nuisance to people in same general area, or those residing below.

Furthermore, with regard to exercise, there are essentially only two free weight chest exercises; the bench press, and the dumb-bell fly. The problem with each of these two basic chest exercises is that neither can be performed without a bench (support device).

2. The "Twister" is a bendable spring device with a handle connected to each end of the spring.

With regard to "The Twister," the disadvantages are: a full range of motion in adduction is not available. The device is constructed in such a way that there is a fixed length to the device which is significantly less than the required length for the starting position (full abduction) of a chest adduction exercise.

Furthermore, this device has only one fixed resistance. Accordingly, it is too difficult for some people to use and too easy for others to use, and certainly it is not designed to accommodate increases in body strength; the obvious goal of all exercises.

3. "The Bullworker"—a compression spring device incorporated within a telescoping pair of tubular cylinders. The disadvantages with the Bullworker are a full range of motion in adduction is also not available. The Bullworker is constructed so that there is a fixed length to the device, which is significantly less than the required length for the starting position (full abduction) for a chest adduction exercise. Furthermore, a full range of motion in adduction is not available with the Bullworker due to the construction of the device, which inhibited the user from fully compressing his/her hands together because the persons hands could, at most, only ever be as close (at maximum adduction) as the length of the longest tubular member, therefore a full range of motion was not available at the ending position (full adduction).

Resistance bands and springs with handles at the ends thereof, while appearing to be chest exercising devices, are in fact not used for chest development. Specifically, when a spring or resistance band device is designed for a starting motion which is a "pulling apart" motion (an abduction motion at the shoulder joint), the exercise which is being performed creates a concentric muscle contraction of the back and shoulder muscles. Further, when the resistance is being released (an adduction motion at the shoulder joint), an eccentric contraction, again to the back and shoulder muscles, occurs. In both instances, for this type of device, neither motion significantly involves the chest muscles.

An ideal chest exercising device would be a combination of the benefits of the first three of the above, while excluding their disadvantages (as would be analogous to a medication that performs its function, but without the side effects), one where the exercise commences with adduction, allows a full range of motion to the user's arms and is easily adjustable for resistance. Such a device would have an added benefit if it could be easily portable and storable.

Additionally, another improvement would be to have a machine that provides the exerciser with the ability to use an infinite number of radial arc planes to exercise the chest muscles.

Another disadvantage to well-known chest exercise machines, for example, the Peck-Deck and Stationary Fly machines, are their restrictions to the user's arms, created by the fixed position of the two movement arms. The first example of restriction is that the horizontal radial arc is fixed at one position, thereby limiting the number of planes available to train the upper, middle and lower areas of the chest muscles, and anything between these areas.

The second example of restriction in the Peck-Deck and Stationary Fly chest machines is that the axis of each rotating lever arm is also fixed, consequently, the span between the two axis is also fixed. Therefore, only an exerciser whose shoulder joints align exactly to these two axis, could expect to use these machines without impingement. These machines, by design limitation, do not provide for an automatic/manual adjustment of the axis to accommodate the user's shoulder joint alignment.

The subject invention, by design, always, and for everyone, does not have a fixed axis of rotation, but instead is designed for natural shoulder adduction/abduction without impingement. It would therefore also be an improvement in the chest exercise machine art to provide a chest exercising machine which allows for a full range of motion, on multiple radial arc planes, with correct shoulder alignment of the exerciser's shoulder joints so as to prevent impingement at the shoulder joints, and the resulting injuries of ligament, tendon and muscle damage, wear and tear on bone tissue and inflammation of the shoulder joints.

SUMMARY OF THE INVENTION

In accordance with the invention, an improved chest exercising device is provided.

The device comprises a free-standing, floor mounted base unit having extending therefrom a pair of pivoting sleeves. Inserted into the sleeves, in an easily removable manner, are a pair of levers. In use, the chest exercising device allows for a full range of adduction and abduction chest exercising arm movements, which movements are easily adjustable for resistance, and due to the pivoting movement of the sleeves, impingement at the shoulder joint is prevented.

It is accordingly an object of the invention to provide an improved chest exercising device.

It is a further object of the invention to provide an improved chest exercising device which is easily disassemblable for convenient storage and portability.

It is yet another object of the invention to provide an improved chest exercising device which allows for a full range of adduction and abduction motion to the user's arms.

It is still a further object of the invention to provide an improved chest exercising device which is easily adjustable for resistance, without the need to manipulate weights, resistance bands or other types of resistance devices.

Still another object of the invention is to provide an improved chest exercising device which allows for a full range of motion, on multiple radial arc planes, with correct shoulder alignment of the exerciser's shoulder joints.

Still a further object of the invention is to provide an improved chest exercising device which avoids the risk of shoulder hyperextension.

It is further an object of the invention to provide an improved chest exercising device which provides continuous resistance throughout the entire range of motion of the device, and wherein the resistance starts immediately and never "kicks out."

Other objects of the invention will in part be obvious and will in part be apparent from the following description.

The invention accordingly comprises an assembly possessing the features, properties and the relation of components which will be exemplified in the product hereinafter described and the scope of the invention will be indicated in the claims.

BRIEF DESCRIPTION OF THE DRAWINGS

For a fuller understanding of the invention, reference is made to the following description taken in consideration with the accompanying drawings, in which.

DETAILED DESCRIPTION OF THE PREFERRED EMBODIMENT

Figure 1A:
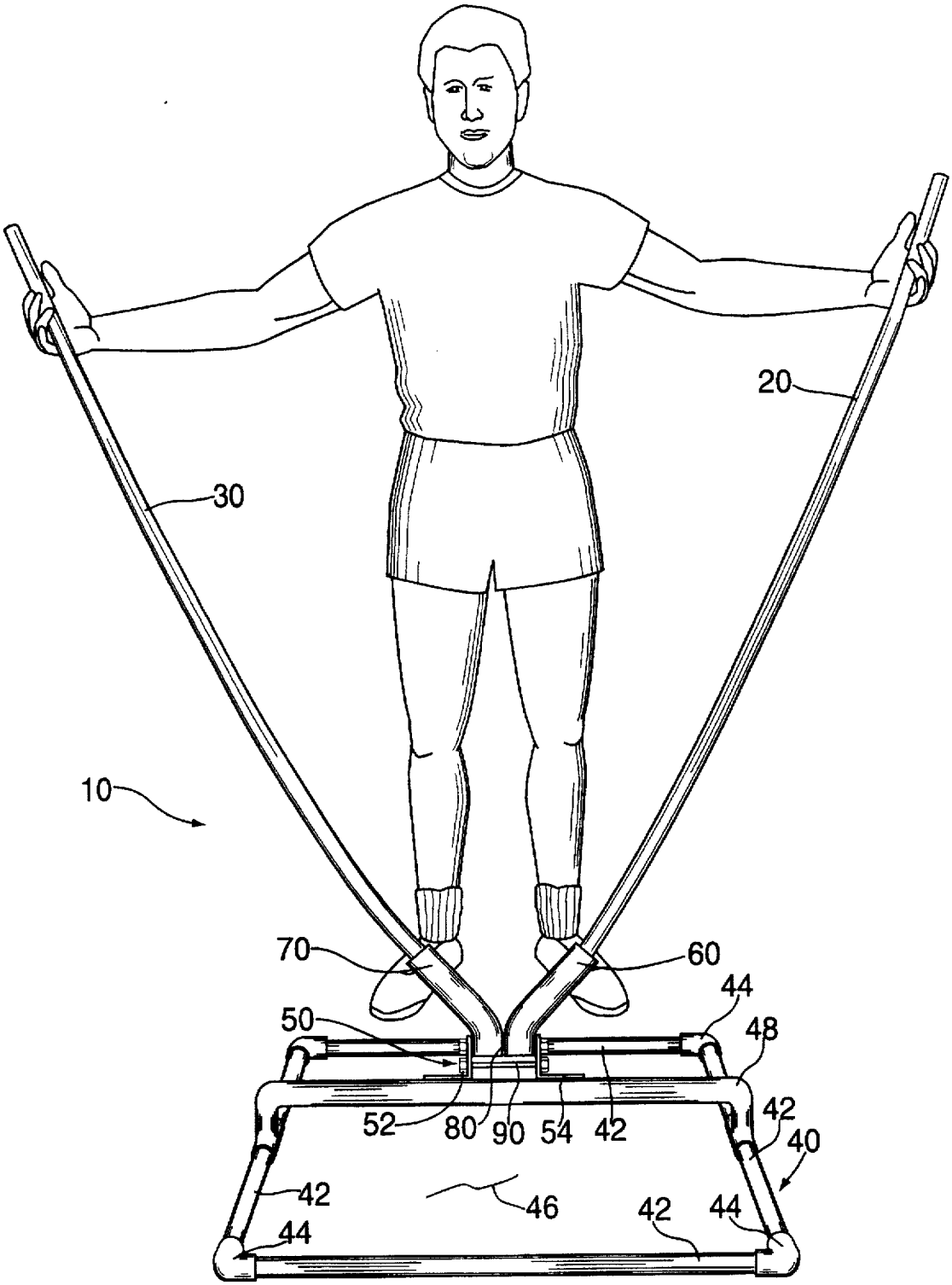
FIG. 1A is a front perspective view showing the exerciser's arms fully abducted.

Referring to the figures, an improved chest exercising device made in accordance with the invention and generally designated at 10 is illustrated. Device 10 comprises base unit 40, pivoting unit 50 and first and second levers 20 and 30, respectively.

Directing attention first to base unit 40, it is to be understood that the unit shown in the drawings is not to be limiting with regard to the scope of the invention. Any unit to which pivoting unit 50 can be adhered, and which supplies stability to device 10 is anticipated (for example, a flat board, made of any material, might also be an appropriate base unit 40).

As seen in the figures, base unit 40 is made up of numerous tubular members 42 and corner tubular members 44. Tubular members 42 and 44 can be PVC pipe, but is not so limited. In construction, base unit 40 is designed to occupy a surface area 46 which provides stability to device 10 during the operation of the chest exercise, as will be discussed in more detail below.

Base unit 40, shown in the figures, is essentially square in shape, but it is equally anticipated that base unit 40 can take on almost any shape (rectangular, circular, arched or any combination thereof), so long as it achieves the purpose of stability. Base unit 40 is also seen to have a vertically extending piece 48, also made of PVC pipe, but able to be made of any other material. Again, it is anticipated, since unit 40 may be of any size or shape or made from any material, that the vertical nature of piece 48 of unit 40 is not mandated.

Attached centrally to piece 48 of unit 40 is pivoting unit 50. Pivoting unit 50 comprises a pair of oppositely facing L channels 52 and 54, a pair of pivoting sleeves 60 and 70 pivotingly attached between channel 52 and 54 by a bolt 80, and a stopping bolt 90.

Figure 6:
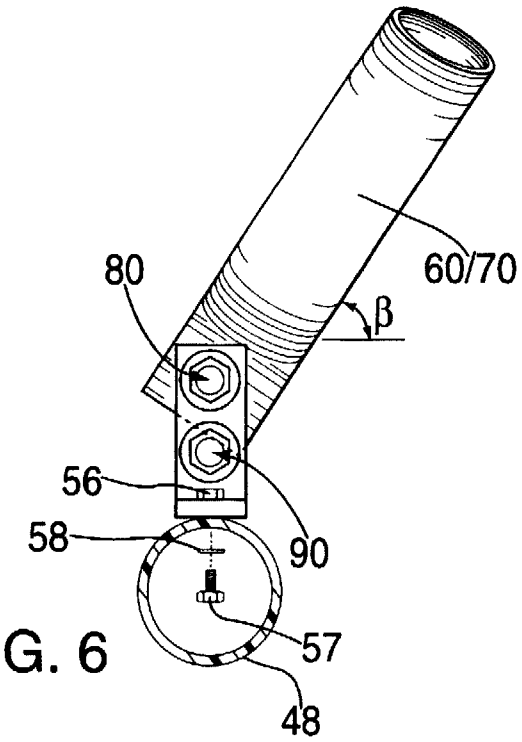
FIG. 6 is a side elevational view and part cross-section of the pivoting sleeve and its mounting to the base unit.
Figure 5:
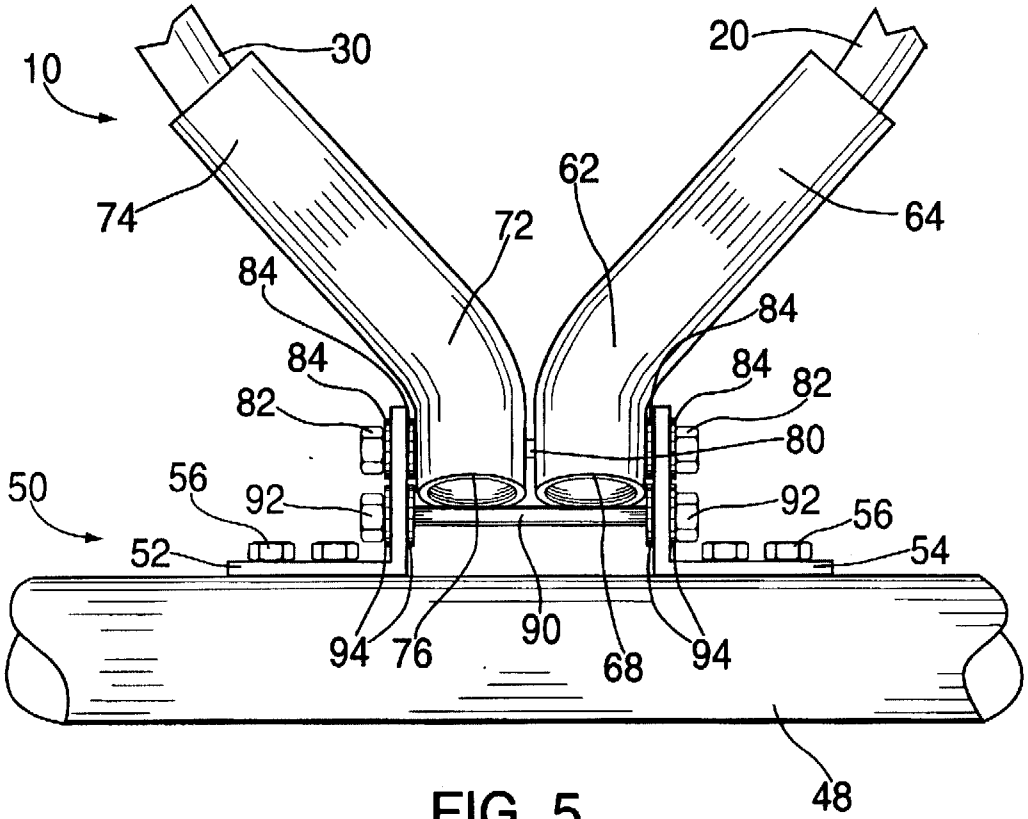
FIG. 5 is a front elevational view of the pivoting sleeve.

As best seen in FIGS. 5 and 6, pivoting sleeves 60 and 70 each have a substantially vertical section 62 and 72 and substantially angled sections 64 and 74. Due to the nature of the construction of device 10, as actually built by the inventor in his individual capacity, it is to be understood that numerous other types of pivoting units 50 and pivoting sleeves 60 and 70 are anticipated. The thrust of the invention, as will be discussed in more detail below, being that the two levers 20 and 30 are removably insertable into sleeves 60 and 70 to provide an upright, free standing, substantially "V" shaped structure which allows for the full, outstretched, range of motion of the exerciser's arms as shown in FIGS. 1A, 1B, 2A, 2B and 3; which full range of motion includes the adduction and abduction movements of the person's arms from the outstretched (to the side) position of FIGS. 1A and 1B, to the forward outstretched position shown in FIGS. 2A, 2B and 3. Accordingly, any combination of elements to create any structure which would allow for the above discussed shape of device 10 and pivoting movement of the elements of device 10 for unrestricted adduction and abduction is anticipated by the invention.

Returning now to a discussion of unit 50, as seen in FIGS. 5 and 6, bolt 80 having standard nuts and washers 82 and 84, respectively, extends through channels 52 and 54 and through portions 62 and 72 of sleeves 60 and 70, so as to pivotly secure sleeves 60 and 70 to unit 50. Sleeves 60 and 70 are obviously allowed to freely rotate around bolt 80.

Sleeves 60 and 70 are, however, restricted from pivoting too far around bolt 80, and are thereby forced to maintain an angled, vertical orientation (not allowed to drop to the floor), by means of their abutment against bolt 90 (see FIG. 6). Bolt 90 is secured below bolt 80, also through channels 52 and 54, but not through sleeves 60 and 70 (see FIG. 5). In operation, the ends 66 and 76 of sleeves 60 and 70 (see FIGS. 5 and 6) hit into bolt 90 if sleeves 60 and 70 pivot too far (at too great an angle) in any one direction. Again, it is not anticipated that the invention is to be restricted to bolt 90 as the only means of preventing full pivoting/rotation of sleeves 60 and 70, this being simply the best mode able to be created by the inventor when building his prototype. More sophisticated, known in the art, methods of preventing rotation/pivoting are anticipated.

Finally regarding unit 50, channels 52 and 54 are secured to piece 48 of unit 40 by means of standard nuts, bolts and washers 56, 57 and 58, respectively, as best seen in FIGS. 5 and 6, through the substantially horizontal portions of channels 52 and 54.

Figure 4:
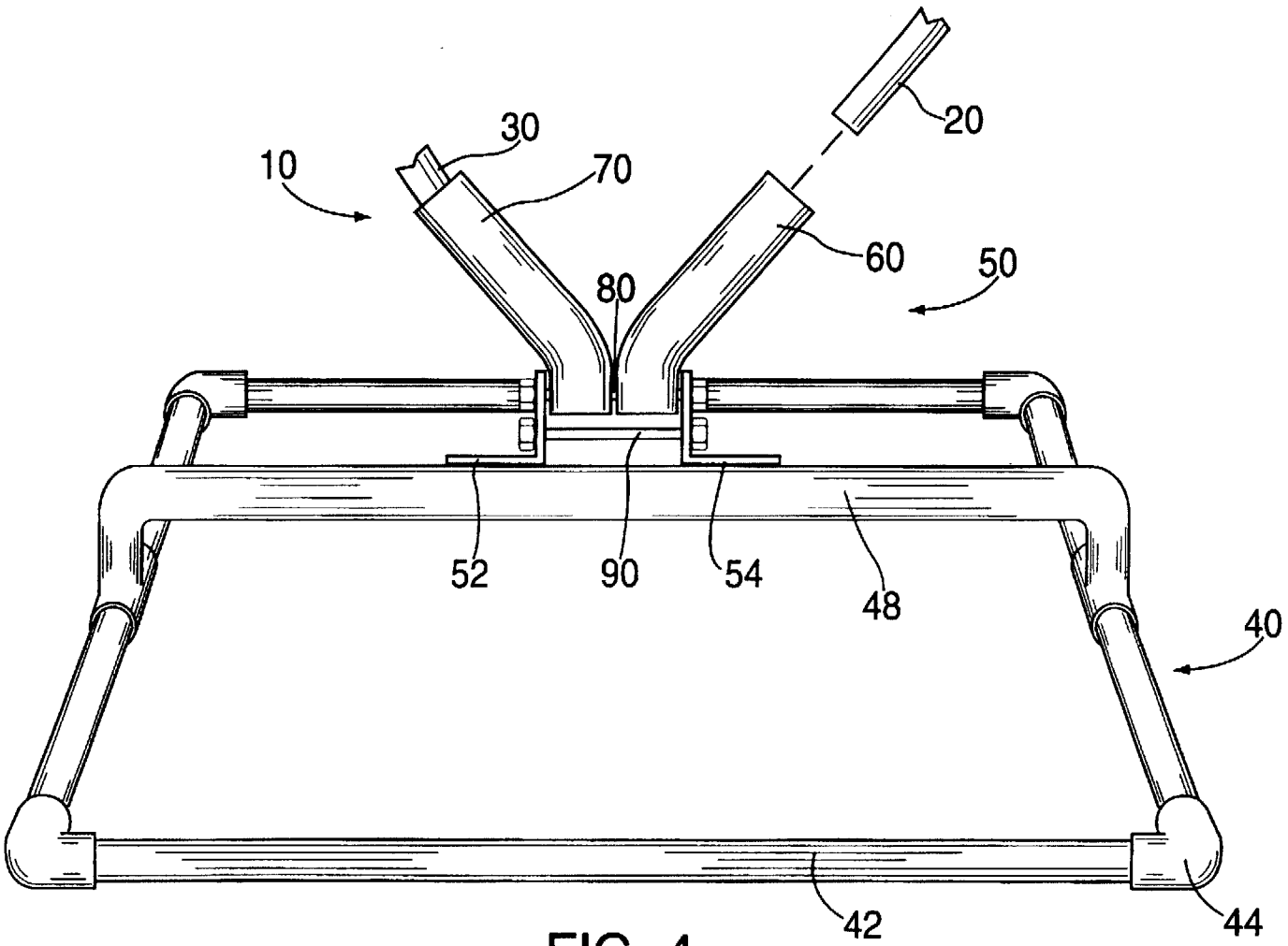
FIG. 4 is a perspective view of the base unit showing a removable lever from the pivoting sleeve.

Turning to FIG. 4, extending into sleeves 60 and 70 are levers 20 and 30. For purposes of the inventor's prototype, sleeves 60 and 70 are also made from PVC pipe, and are therefore tubular in nature so as to allow easy insertability of levers 20 and 30. Levers 20 and 30 will extend within sleeve 60 and 70 up to the point of bending between portions 62/72 and 64/74 of sleeves 60 and 70, respectively.

It is anticipated that a material as simple as tubular PVC pipe can be used for levers 20 and 30, but that more sophisticated materials such as those used in present day poles used in pole-vaulting can also be used to construct levers 20 and 30. Resistance is obtained in device 10 based upon the rigidity of the material used for levers 20 and 30. Accordingly, levers 20 and 30 made from standard PVC pipe will provide less resistance to the exerciser than if levers 20 and 30 were constructed of more rigid material.

Figure 2A:
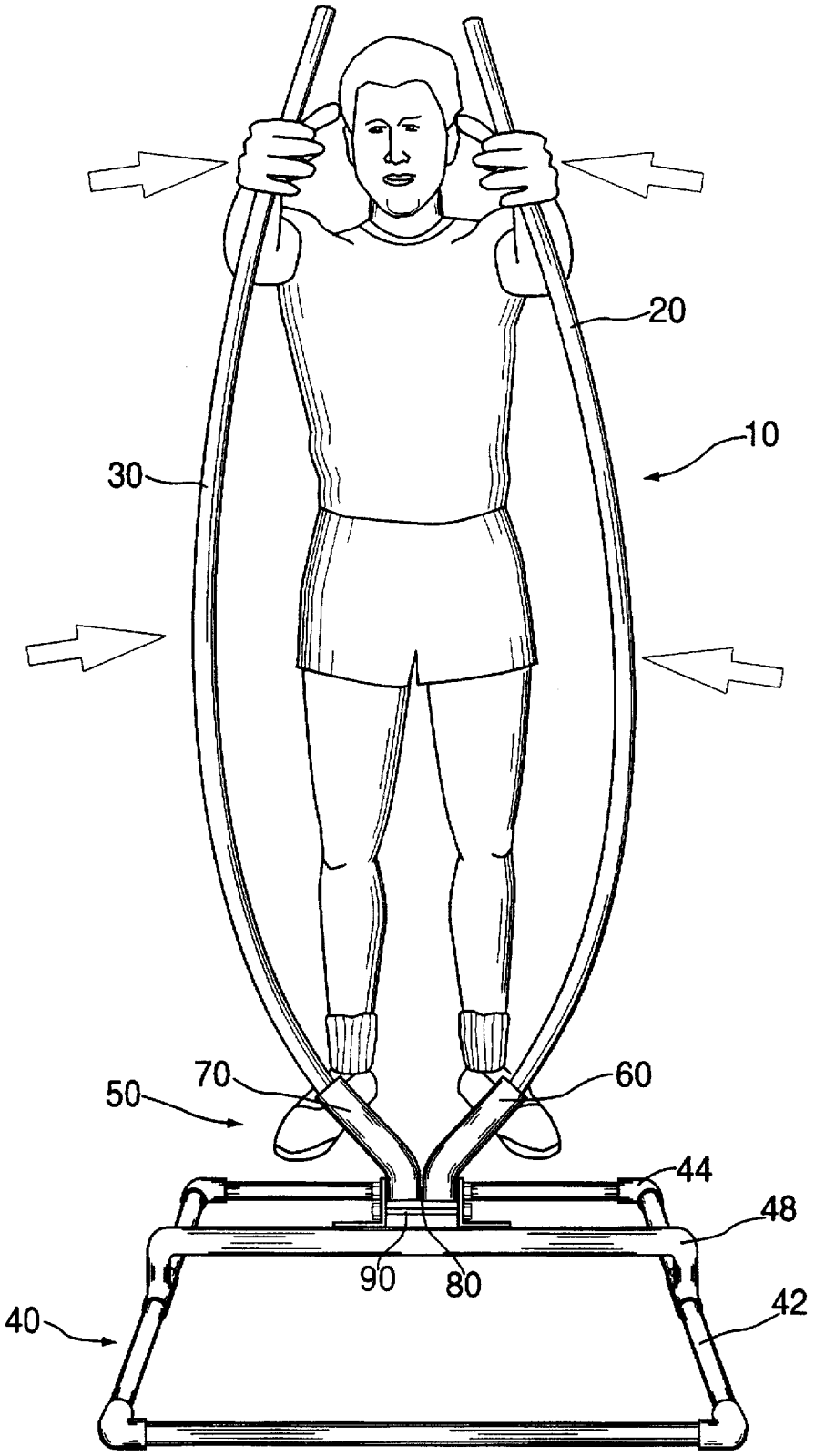
FIG. 2A is a front perspective view showing the exerciser's arms fully adducted.
Figure 2B:
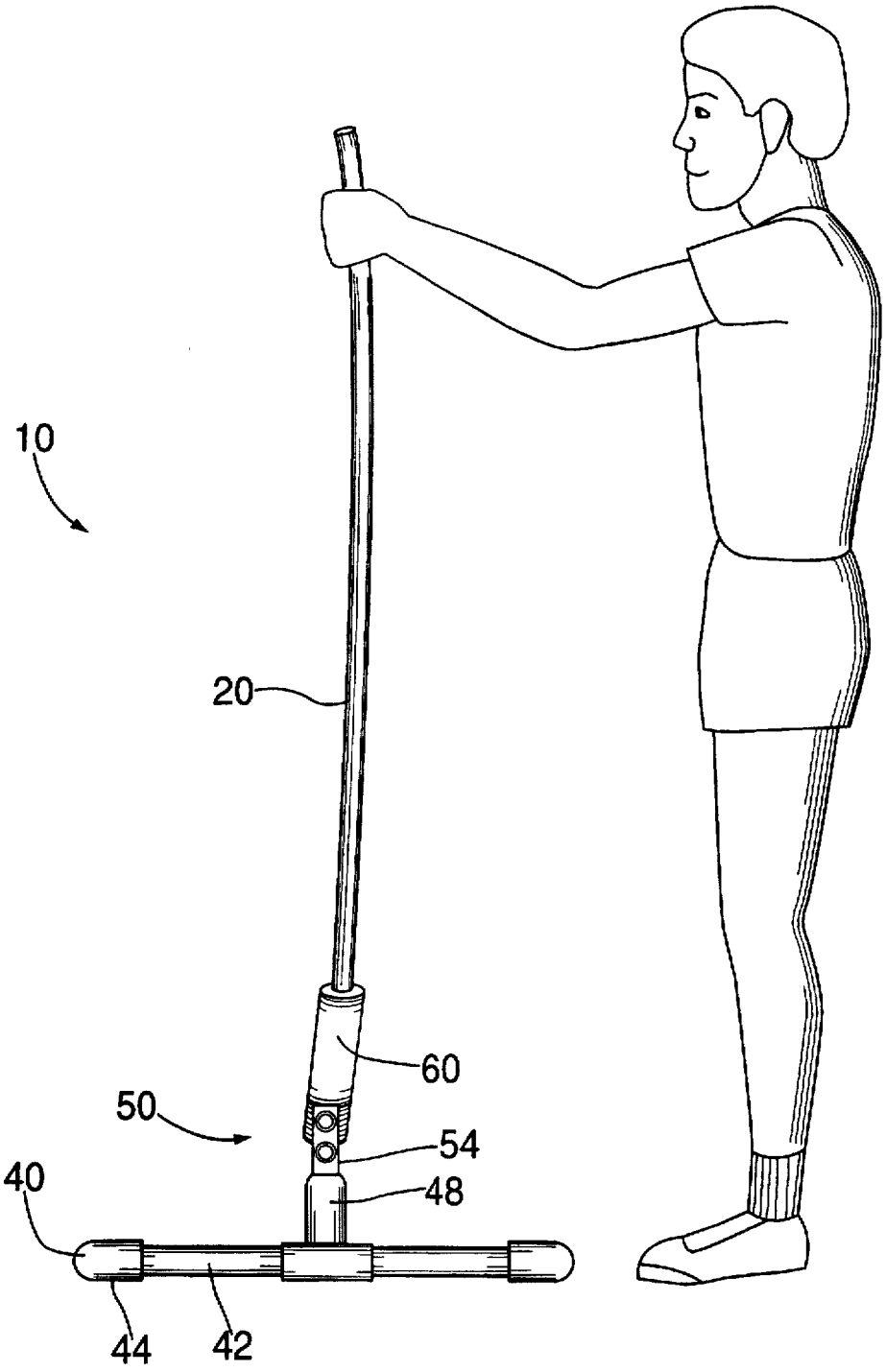
FIG. 2B is a side elevational view of FIG. 2A also showing the exerciser's arms fully adducted.
Figure 3:
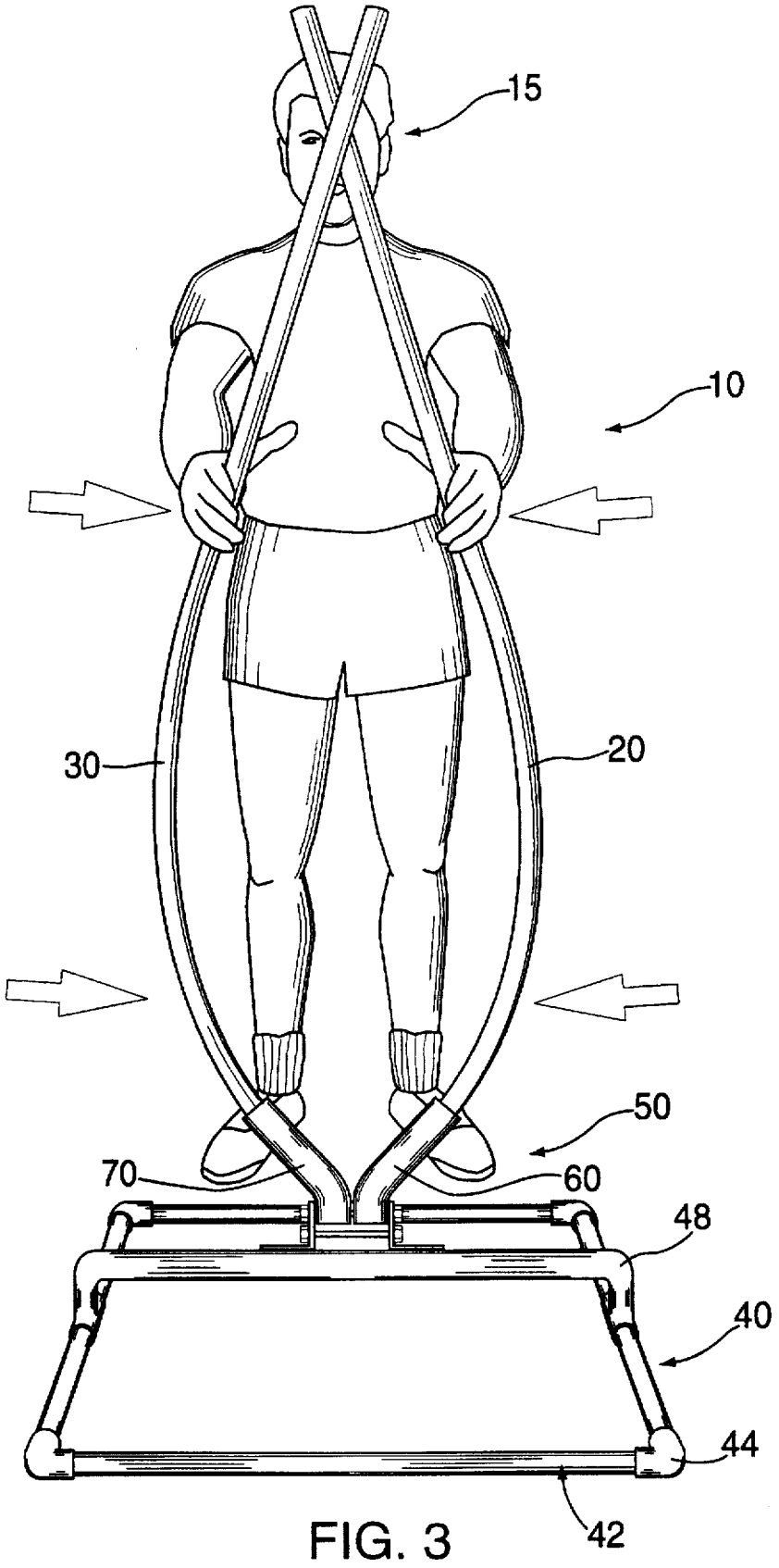
FIG. 3 is a front perspective view showing the user's hands in a lower position on the levers.

As seen in FIG. 3, further adjustments in resistance can be achieved by moving one's arms towards the middle of levels 20 and 30, as opposed to positioning them at the ends thereof, as seen in FIGS. 1 and 2. Therefore, resistance can be varied through use of different materials for levers 20 and 30 and, then fine tuned by movement of the user's arms along levers 20 and 30.

Figure 1B:
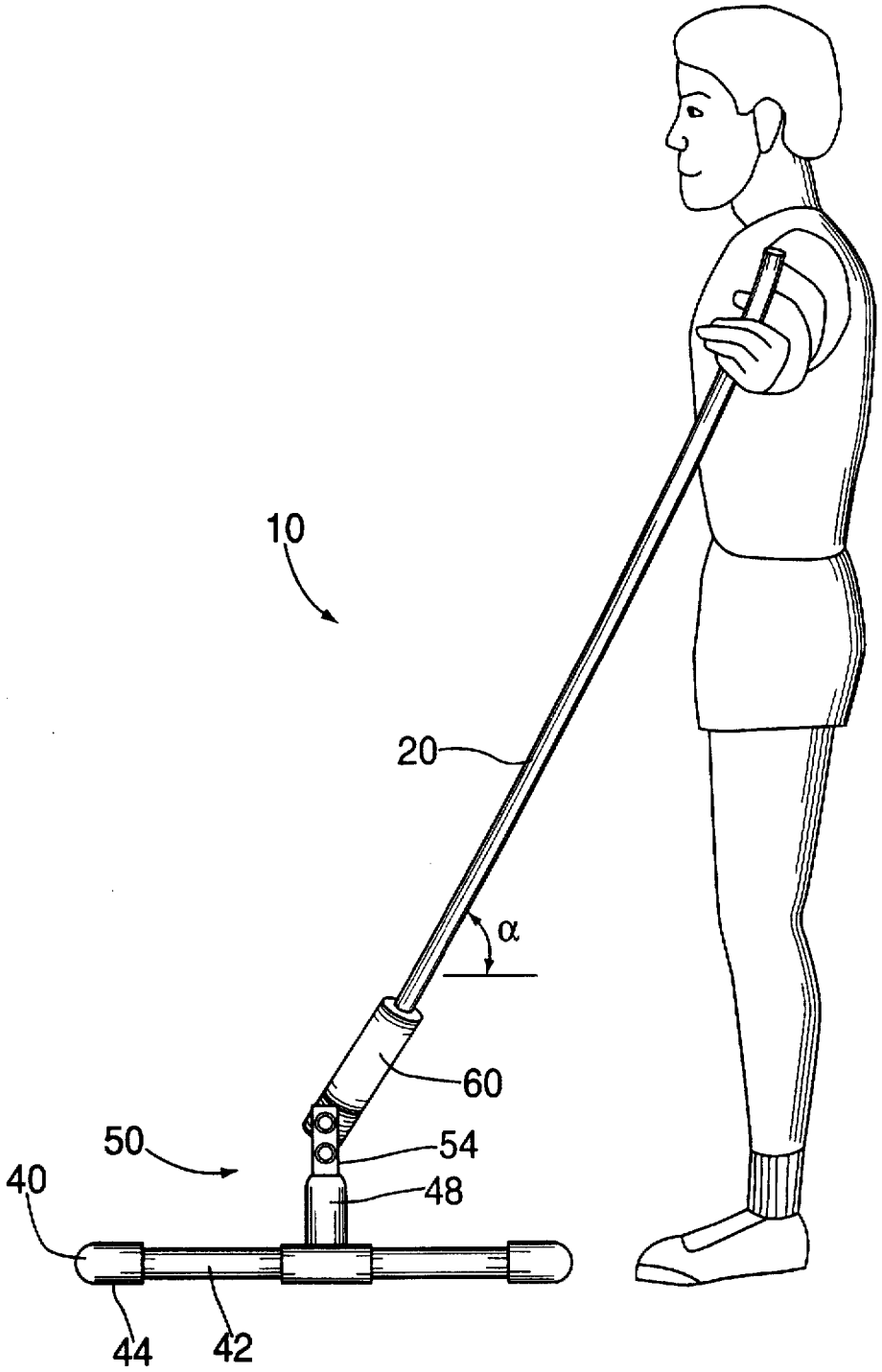
FIG. 1B is a side elevational view of FIG. 1A also showing the exerciser's arms fully abducted.

In operation, as has been previously discussed, a person will commence the chest exercise by fully extending his/her arms out from the sides of his/her body as seen in FIGS. 1A and 1B. As seen in FIG. 1B, levers 20 and 30 of device 10 are at some angle $\alpha$ to the horizontal when the exerciser is ready to commence the exercise. Angle $\alpha$ does not have to be the minimum angle allowed (angle $\beta$ is the minimum, as seen in FIG. 6) when ends 66/76 of sleeves 60 and 70 abut against bolt 90. Angle $\alpha$ will vary depending upon the distance the exerciser stands from device 10 and the range of motion of the exerciser's arms.

In performing the exercise, the exerciser then rotates his/her arms in an adduction motion so that his/her arms are substantially horizontally situated in a full outstretched manner in front of him/her, as seen in FIGS. 2A and 2B. Due to the free pivoting nature of unit 50, device 10 prevents impingement at the shoulder joint, and thereby prevents the known medical consequences of ligament, tendon and/or muscle damage, as well as preventing excessive wear and tear on bone tissue and/or inflammation and related disorders to one's muscles.

As seen in FIG. 2A, levers 20 and 30 bend due to their being secured within sleeves 60 and 70 and having the force of the exerciser's arms on levers 20 and 30. It is this bending which creates resistance in levers 20 and 30 and therefore the resistance of device 10.

Turning to FIG. 3, the end result of an adduction movement of the exerciser's arms is seen, however, the exerciser's arms are in a position closer to the centers of levers 20 and 30. In this manner, as has been previously discussed, additional resistance can be added to the exercise.

FIG. 3 also shows that sleeves 60 and 70, while substantially pivoting/rotating together, are nevertheless independent of one another. This independence allows for the "crossing" of levers 20 and 30, as seen at the top of FIG. 3 at 15.

It is further obvious from the invention that an exercising abduction motion is also achieved simply by the outward movement of the exerciser's arms, as from the position shown in FIG. 2, to the position shown in FIG. 1.

It will thus be seen that the objects set forth above, among those made apparent from the preceding description, are efficiently attained and, since certain changes may be made in the above constructions without departing from the sphere and scope of the invention, it is intended that all matters contained in the above description and shown in the accompanying drawings shall be interpreted as illustrative and not as a limiting sense.

It is also to be understood that the following claims are intended to cover all of the generic and specific features of the invention herein described and all statements of the scope of the invention which, as a matter of language, might be said to fall therebetween.

What is claimed is:

1. A chest exercising device, comprising:

a base unit for placement upon a supporting surface.

at least first and second independently pivoting sleeve members secured to and extending from said base unit, said sleeve members being secured substantially adjacent and in contact to each other at said base unit;

a first resilient lever partially, slidably, removably positioned within said first sleeve member and a second resilient lever partially, slidably, removably positioned within said second sleeve member; and said sleeve members extend upwardly and away from each other so that said resilient levers are biased apart from each other and proved resistance against being pulled together by a user.

2. A chest exercising device as recited in claim 1, wherein said sleeve members are hollow, tubular members to allow for easy insertion and removal of said first and second levers.

3. A chest exercising device as recited in claim 2, wherein said levers are flexible.

4. A chest exercising device as recited in claim 3, wherein said flexibility of said levers provides resistance for the chest exercise of said exercising device.

5. A chest exercising device as recited in claim 1, wherein there is no unsafe inward rotation while adducting, at the shoulder, elbow and wrist joints of a user of said device due to said sleeve members being secured substantially adjacent to each other at said base unit.

6. A chest exercising device as recited in claim 1, said first lever having first and second ends, wherein said first lever is slideably, removably positioned within said first sleeve member at said first end thereof;

said second lever having first and second ends, wherein said second lever is slideably, removably positioned within said second sleeve member at said first end thereof; and wherein longitudinal axes through substantial portions of each of said first and second levers intersect each other.

7. A chest exercising device, comprising:

a base unit for placement upon a supporting surface;

at least first and second independently pivoting sleeve members secured to and extending from said base unit, said sleeve members being secured substantially adjacent and in contact to each other at said base unit;

a first resilient lever having first and second ends, wherein said first lever is partially, slidably, removably positioned within said first sleeve member at said first end thereof; and a second resilient lever having first and second ends, wherein said second lever is partially, slidably, removably positioned within said second sleeve member at said first end thereof, and said sleeve members extend upwardly and away from each other so that said resilient levers are biased apart from each other and proved resistance against being pulled together by a user.

wherein longitudinal axes through substantial portions of each of said first and second levers intersect each other.

8. A chest exercising device as recited in claim 7, wherein said sleeve members are hollow, tubular members to allow for easy insertion and removal of said first and second levers.

9. A chest exercising device as recited in claim 8, wherein said levers are flexible.

10. A chest exercising device as recited in claim 9, wherein said flexibility of said levers provides resistance for the chest exercise of said exercising device.

11. A chest exercising device as recited in claim 7, wherein said sleeve members are secured substantially adjacent to each other at said base unit.

12. A chest exercising device as recited in claim 11, wherein there is no unsafe inward rotation while adducting, at the shoulder, elbow and wrist joints of a user of said device due to said sleeve members being secured substantially adjacent to each other at said base unit.

* * * * *

UNITED STATES PATENT AND TRADEMARK OFFICE

CERTIFICATE OF CORRECTION

PATENT NO : 5,755,649

DATED : May 26, 1998

INVENTOR(S) : Michael Bimby

It is certified that error appears in the above-identified patent and that said Letters Patent is hereby corrected as shown below:

In the drawings;

In Fig. 5, change "68" to -- 66 --.

At Column 4, line 63, and Column 5, line 3, change "adduction and abduction" to -- abduction and adduction --.

At Column 6, line 55, change "proved" to -- provide --.

Signed and Sealed this

Thirteenth Day of July, 1999

*Attest:*

*Attesting Officer*

Q. TODD DICKINSON

*Acting Commissioner of Patents and Trademarks*